US011280125B1

(12) United States Patent
Christie

(10) Patent No.: US 11,280,125 B1
(45) Date of Patent: Mar. 22, 2022

(54) LID LIFTING DEVICE

(71) Applicant: Firm Fresh, LLC, Westlake Village, CA (US)

(72) Inventor: John Christie, Westlake Village, CA (US)

( * ) Notice: Subject to any disclaimer, the term of this patent is extended or adjusted under 35 U.S.C. 154(b) by 399 days.

(21) Appl. No.: 16/398,629

(22) Filed: Apr. 30, 2019

Related U.S. Application Data

(60) Provisional application No. 62/827,310, filed on Apr. 1, 2019.

(51) Int. Cl.

| | |
|---|---|
| ***A47B 96/06*** | (2006.01) |
| ***E05F 1/12*** | (2006.01) |
| ***B65F 1/16*** | (2006.01) |
| ***E05F 15/53*** | (2015.01) |

(52) U.S. Cl.
CPC ..... *E05F 1/1292* (2013.01); *B65F 1/1623* (2013.01); *E05F 1/1261* (2013.01); *E05F 15/53* (2015.01); *E05Y 2201/422* (2013.01); *E05Y 2201/478* (2013.01); *E05Y 2900/604* (2013.01)

(58) Field of Classification Search
CPC ..... E05F 1/1292; E05F 1/1261; E05F 15/53; E05Y 2201/422; B65F 1/1623; B65F 2001/1669
USPC ..... 220/263, 264
See application file for complete search history.

(56) References Cited

U.S. PATENT DOCUMENTS

| | | | | | |
|---|---|---|---|---|---|
| 2,483,947 | A * | 10/1949 | Turner | E05F 1/1058 | 217/60 C |
| 3,457,584 | A * | 7/1969 | Phelps | E05F 1/1261 | 16/290 |
| 4,775,066 | A * | 10/1988 | Keppeler | B65F 1/004 | 220/484 |
| 5,335,451 | A * | 8/1994 | Druzynski | E05F 1/1075 | 49/379 |
| 5,465,557 | A * | 11/1995 | Harte | B65B 31/02 | 16/289 |
| 6,024,238 | A * | 2/2000 | Jaros | B65F 1/163 | 16/84 |
| 9,067,731 | B1 * | 6/2015 | Jackson | B65F 1/1623 | |
| 2008/0272119 | A1 * | 11/2008 | Efstathiou | B65F 1/163 | 220/264 |

* cited by examiner

*Primary Examiner* — Don M Anderson
*Assistant Examiner* — Elizabeth J Volz
(74) *Attorney, Agent, or Firm* — Sandy Lipkin

(57) ABSTRACT

An apparatus and method for easily and simply lifting and holding upon a heavy cumbersome lids, such as those found on large trash containers thereby allowing the user the use of both hands for hoisting and dumping the trash without having to hold open the lid with one hand or other body part. Furthermore, the use of an external device to lift and hold open the lid makes it easier to keep the task hygienic.

8 Claims, 6 Drawing Sheets

LID LIFTING DEVICE

REFERENCE TO PRIOR APPLICATION

This application claims priority of the provisional patent application 62/827,310, filed Apr. 1, 2019 entitled LID LIFTING DEVICE by John Christie.

BACKGROUND OF THE INVENTION

Field of the Invention

The field of this invention is a device for assistance in keeping a lid open and more particularly toward an arm assembly to be attached to primarily large commercial trash containers (dumpsters) said arm assembly being capable of lifting open the large, cumbersome, and sometimes heavy lids found thereon and keep them open, thereby allowing the person putting trash therein to maintain the use of both hands in order to lift trash bags or small trash containers into the dumpster.

Description of the Prior Art

Large trash containers, commonly called trash dumpsters are common in commercial business areas, such as office buildings, restaurants and large residential areas, such as apartment buildings. These large trash dumpsters contain large, bulky and somewhat heavy lids. The lids are routinely kept shut because of commercial code requirements in order to keep the large volume of trash secured therein and to keep the ambient area free from odors, animals, birds, vermin, as well as keeping weather elements from getting into the trash container.

When taking a bag or container of garbage out to a trash dumpster the user typically must open the lid and hold it open so that trash can be placed therein. When a person of modest strength must perform this task, especially with multiple or heavy trash bags or containers of garbage, it can be quite a challenge to keep the lid open, on the one hand, and heave the garbage into the container with the other hand. Indeed, often it is the case that the person employs some unpleasant gymnastics in order to perform this task such as using their head to keep the lid open while lifting or hoisting the garbage with both hands. Many times, because of the challenges in lifting the dumpster lid, the commercial dumpster lid is often left open, thereby allowing animals, birds, vermin, or weather conditions (rain, snow, heat) to mix in with the dumpster trash and cause more issues with health, debris, odors, and commercial ordinance requirements.

Whether using the head or even one bare hand to keep the lid open, hygiene also becomes an issue as the lid can be contaminated with foul refuse that has been thrown in the dumpster. It is the object of the instant invention to provide a simple device and method of using same to keep the lid open while in use and closing easily thereafter. Furthermore, it is a further object of the instant invention to provide a device that is separate from the lid and that can be more easily kept clean or transferred to another dumpster that is being replaced at the trash dumpster's location.

SUMMARY OF THE INVENTION

The instant invention defines an apparatus that is designed to mount onto a commercial dumpster and lift the cumbersome plastic lid up, thereby allowing a person to throw away their trash with both hands free from holding the dumpster lid to perform the task of throwing out the trash. The apparatus is specifically engineered with metal mounting brackets, a gas spring shock, mounting hardware, and fiberglass arms that can be adjusted in length to accommodate commercial trash dumpsters of different sizes and shapes.

The preferred embodiment of the instant invention provides for an apparatus to aid in the lifting a lid to a dumpster and maintaining it in the open position comprising: a main mounting bracket for attachment to the side top rim of said dumpster, said main mounting bracket attaching on end to said side top rim of said dumpster and on the opposite end providing a space for the placement and securement therein of a pivot arm; a lower mounting arias attached to the bottom of said main mounting bracket, said lower mounting arm being substantially parallel to said side top rim of said dumpster and angled downward therefrom; a gas spring attached to the distal end of said lower mounting arm on one end and attached to said pivot arm on the opposite end; an adapter tube secured inside of said pivot arm; an intermediate tube connected to said adapter tube and secured thereto with a first tube clamp; an end tube connected to said intermediate tube and secured thereto with a second tube clamp; an eyelet bolt attached to the distal end of said end tube; a cross swing arm positioned substantially parallel to said end tube and extending into the interior of said dumpster and resting against the lid of said dumpster when said dumpster is resting on the ground and that swings outward away from said dumpster lid when said dumpster is turned upside down to remove refuse contained therein.

The above embodiment can be further modified by defining that a strap is placed through said eyelet bolt.

The above embodiment can be further modified by defining that a pair of cross arm pivot plates are placed around said cross swing arm and affixed to said end tube to allow said cross swing arm to pivot therebetween.

The above embodiment can be further modified by defining that a pivot guard attached to the portion of said main mounting bracket that houses said pivot arm.

The above embodiment can be further modified by defining that a pivot stop on the back of said pivot arm.

The above embodiment can be further modified by defining that a hex bolt on said main mounting bracket.

An alternate embodiment of the instant invention provides for a method of lifting a lid to a dumpster and maintaining it in the open position comprising the steps of: attaching an apparatus to the perimeter of the open top of a dumpster said apparatus further comprising: a main mounting bracket for attachment to the side top rim of said dumpster, said main mounting bracket attaching on end to said side top rim of said dumpster and on the opposite end providing a space for the placement and securement therein of a pivot arm; a lower mounting arm attached to the bottom of said main mounting bracket, said lower mounting arm being substantially parallel to said side top rim of said dumpster and angled downward therefrom; a gas spring attached to the distal end of said lower mounting arm on one end and attached to said pivot arm on the opposite end; an adapter tube secured inside of said pivot arm; an intermediate tube connected to said adapter tube and secured thereto with a first tube clamp; an end tube connected to said intermediate tube and secured thereto with a second tube clamp; an eyelet bolt attached the distal end of said end tube; a cross swing arm positioned substantially parallel to said end tube and extending into the interior of said dumpster and resting against the lid of said dumpster when said dumpster is resting on the ground and that swings outward away from said dumpster lid when said dumpster is turned upside down to remove refuse contained therein; applying pressure to said eyelet bolt at the end of said end tube to either move said pivot arm upward to open said lid or downward to close said lid wherein said gas spring provides the force to open or close said lid.

The above embodiment can be further modified by defining that a strap is placed through said eyelet bolt.

The above embodiment can be further modified by defining that a pair of cross arm pivot plates are placed around said cross swing arm and affixed to said end tube to allow said cross swing arm to pivot therebetween.

The above embodiment can be further modified by defining that a pivot guard attached to the portion of said main mounting bracket that houses said pivot arm.

The above embodiment can be further modified by defining that a pivot stop on the back of said pivot arm.

The above embodiment can be further modified by defining that a hex bolt on said main mounting bracket.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
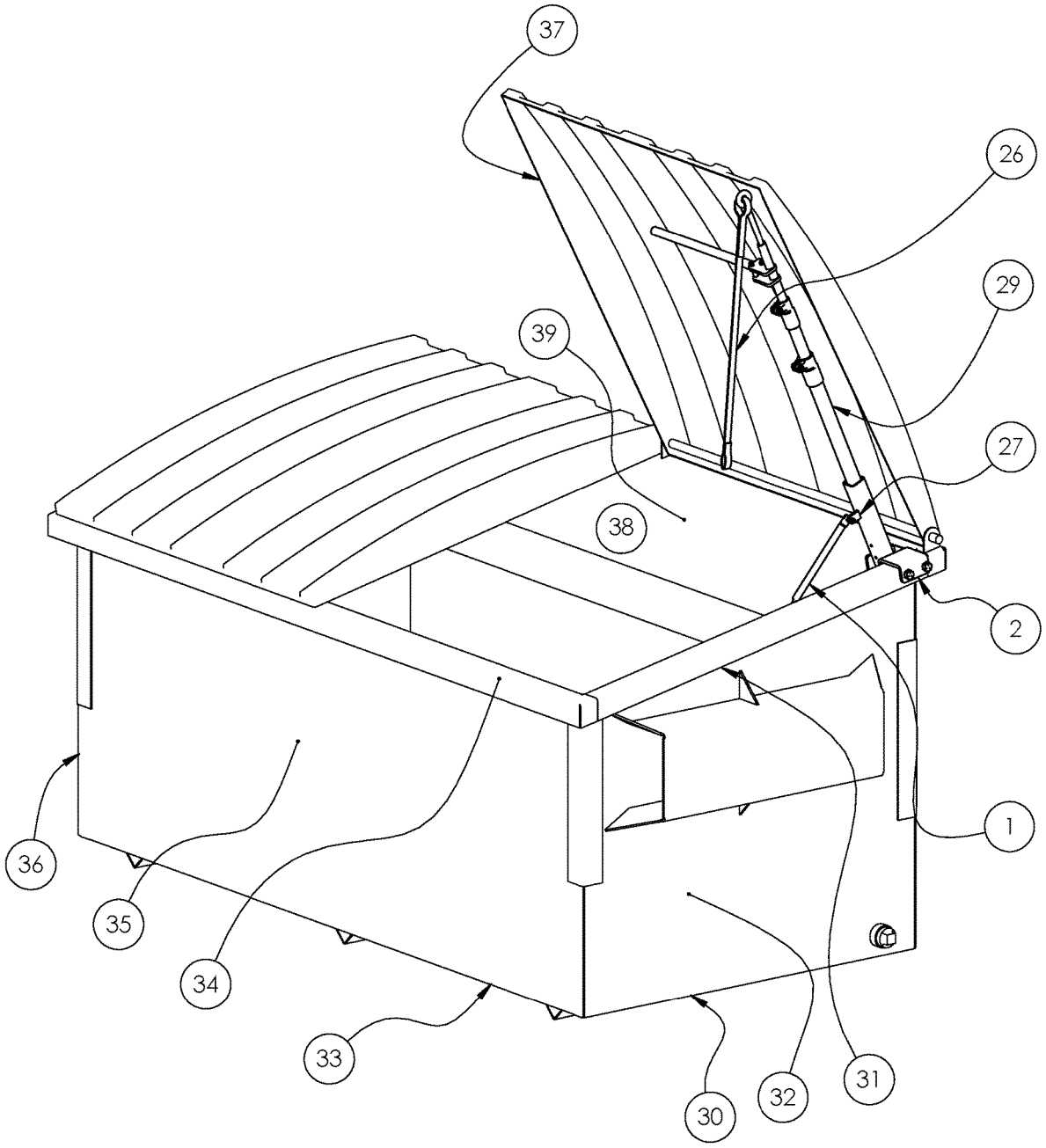
FIG. 1 is an angled right side perspective view of a common commercial trash receptacle, commonly called a trash dumpster, with the device of the instant invention installed and holding the lid of said large trash dumpster in the open position.

Turning to the drawings, the preferred embodiment is illustrated and described by reference characters that denote similar elements throughout the several views of the instant invention.

In FIG. 1 the preferred embodiment is shown as if facing the dumpster's front panel 35 from a front right angled view. The preferred embodiment is an apparatus 29 that is attached to the right panel 32 top rim 31 of a common commercial trash dumpster 30. The trash dumpster 30 has a back panel 39, a front panel 35, one right side panel 32 and left side panel 36, and a bottom floor panel 33 that in combination define an empty space 38 therebetween for the placement therein of refuse. The rear panel 39, front panel 35 and left and right side panels 32, 36 combine to form a substantially rectangular shape having an open top with a top perimeter defined by a left top rim 40 (See FIG. 2), right top rim 31, front top rim 34, and back top rim 41 (See FIG. 2). Each top rim 40, 31, 34, 41 corresponds with each of the side panels 36, 32, 35, 39. A movable lid 37 is placed over said top perimeter for containment of the refuse therein. The dumpster lid 37 is attached and hinged by the dumpster manufacturer to the back top rim 41 and hinges up and down to open close in order to access the dumpster's empty space 38. Most commercial dumpsters 30 have two equal in size plastic dumpster lid halves 37 covering perimeter locations of the front 34, left 40, right 31, and rear 41 top rims of the dumpster 30.

Figure 5:
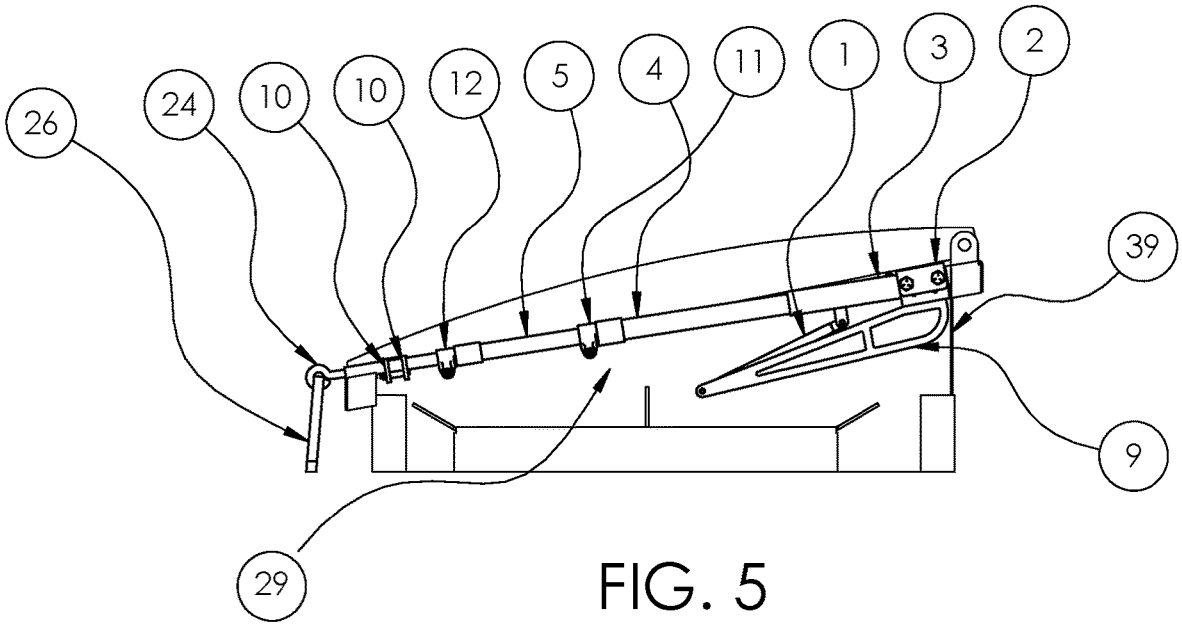
FIG. 5 is a side view of the device of the instant invention as it is attached to the side of a large trash dumpster in the closed lid position.

The device 29 of the instant invention is installable on either the left 40 or right 31 top rims, located above one of the associated left or right panels 36, 32 of the dumpster 30. The device 29 operates using a gas spring 1 with specifically designed internal gas extension force that allows the device 29 to travel specifically designed extended and compressed lengths, which allows for easy opening and closing. In operation, with the dumpster 30 closed (See FIG. 5), a portion of an eyelet bolt 24 of the device 29 extends outward from the dumpster lid 37. The eyelet bolt 24, as shown in FIGS. 1 and 5, provides for placement of a removable strap 26, which can allow the user to initiate the lifting or pulling down of the device 29 and consequently the dumpster lid 37. The device 29 can be activated through the application of upward force on the extending eyelet bolt 24, which when the dumpster lid 37 is raised 4 to 6 inches above the dumpster's front top rim 34, the internal expansion force in the gas spring 1 takes over the upward lift motion and allows for lifting of the dumpster lid 37 into the required and designed open position.

Similarly, to close or pull down the dumpster lid 37, the user grabs a removeable strap 26 that is attached to protruding eyelet bolt 24 of the device 29 by applying force in a downward pulling direction, thereby compressing the gas spring 1 to close the lid 37 of the dumpster 30 until the shank of the eyelet bolt 24 reaches the front top rim 34 (FIG. 5).

Figure 3:
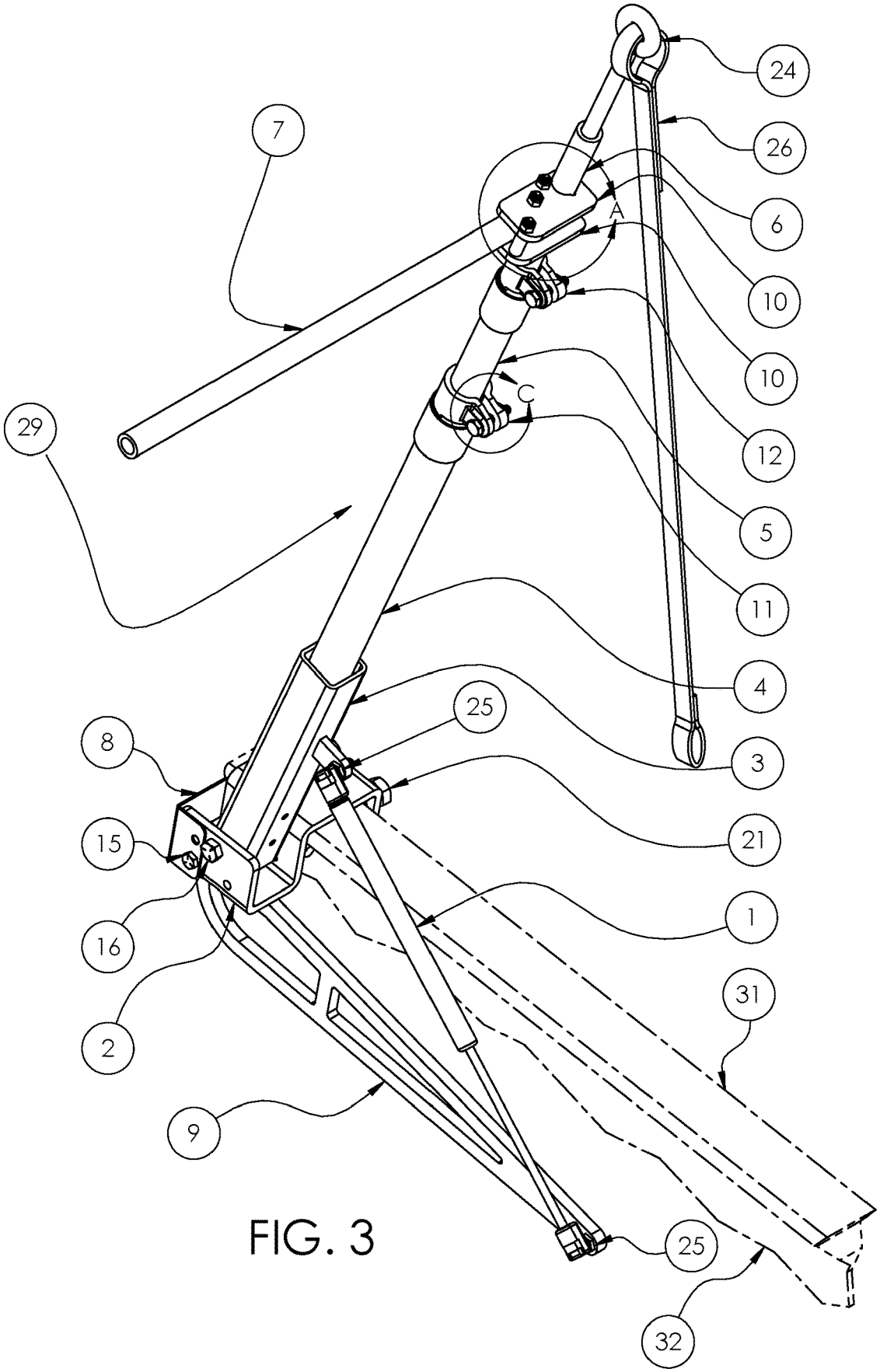
FIG. 3 is a top perspective view of the device from inside the dumpster of the instant invention as it is attached to the side of a common commercial trash dumpster (shown in phantom) in the open position.
Figure 4:
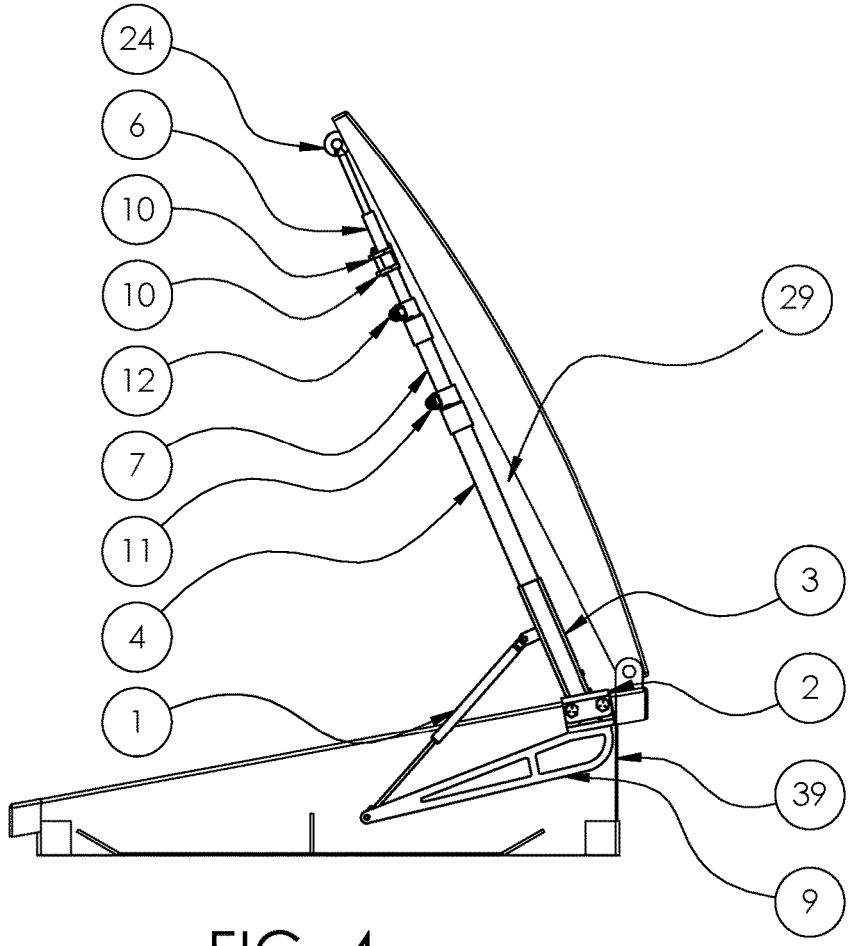
FIG. 4 is side view of the device of the instant invention as it is attached to the side of a large trash dumpster in the open lid position.

Turning to FIG. 3, the device 29 is seen in detail as it attaches to the dumpster's right-side top rim 31. A main mounting bracket 2 is attached to the dumpster's right side top rim 31 with two main mounting bracket hex bolts 21 that, when tightened, secure the main mounting bracket 2 to the dumpster's right side top rim 31. Attached to the bottom of the main mounting bracket 2 is a lower gas spring mounting arm 9 that allows the lower end of the gas spring 1 to be attached to a gas spring ball stud 25 (See FIGS. 3 and 7). The lower gas spring mounting arm 9 is positioned at a specific angle so that the when the dumpster lid 37 is in the closed position (FIG. 5) and the gas spring 1 is compressed, the internal expansion gas does not lift the dumpster lid until the user lifts the eyelet bolt 24 to at least 4 to 6 inches above the dumpster's front top rim 34.

Also attached to the main mounting bracket is a pivot arm 3. The pivot arm 3 is attached to the main mounting bracket 2 with a ⅜" pivot arm hex bolt 16. The pivot arm 3 in operation pivots up and down from the main mounting bracket 2. Along the bottom of the pivot arm 3 there is affixed an upper gas spring mounting bracket 27 (See FIG. 7) that allows the upper end of the gas spring 1 to be attached to a gas spring ball stud 25, and allows the internal extension gas force in the gas spring 1 to push the pivot arm 3 up. At the back of the pivot arm is a pivot arm stop 28 (See FIG. 7) that allows the pivot arm 3 to stop lifting at a proscribed height, thereby disallowing the gas spring 1 to reach its fully extended length. The pivot arm stop 28 is located on the pivot arm 3 so that when the pivot arm 3 reaches the desired height and angle, it hits the ¼" stop/guard hex bolt 15 located on main mounting bracket 2.

Figure 2:
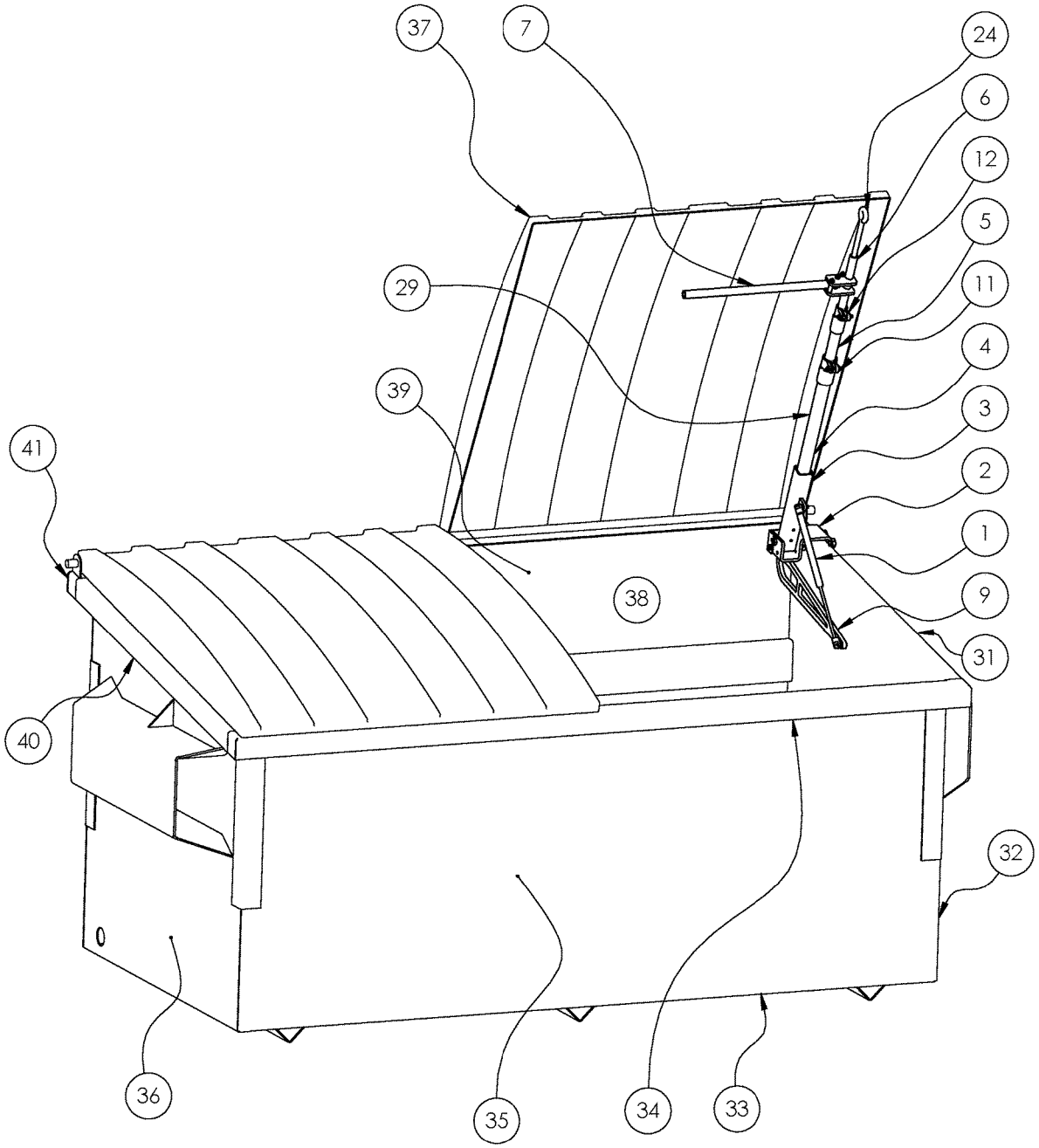
FIG. 2 is a front angled, slightly left view of a common commercial trash dumpster with the device of the instant invention installed and holding the lid of said large trash dumpster in the open position.

Turning to FIG. 2 or 3, extending outward from the pivot arm 3 are three adjustable telescopic tubes: an adapter tube 4 that when inserted into the pivot arm 3 is attached at a specific location in the pivot arm 3 with two ¼" button head bolts 23 (see FIG. 7), an intermediate tube 5 and an end tube 6. The protruding eyelet bolt 24 terminates at the end of the end tube 6. Attached to the end of adapter tube 4 and intermediate tube 5 are specifically designed polycarbonate tube clamps 11, 12. Because dumpsters are made in different sizes, these tube clamps 11, 12 allow the intermediate tube 5 and the end tube 6 to be telescopically adjusted in or out at the required dumpster lid's 37 length. The telescopic length adjustment of intermediate tube 5 and end tube 6 allows the eyelet bolt's round eye 24 to be positioned in the required 2" past the end of the dumpster's front top rim 34 (See FIG. 5), thereby allowing the eyelet bolt's 24 shank to bottom out at the dumpster's front top rim 34 and properly close the dumpster lid 37.

Figure 8:
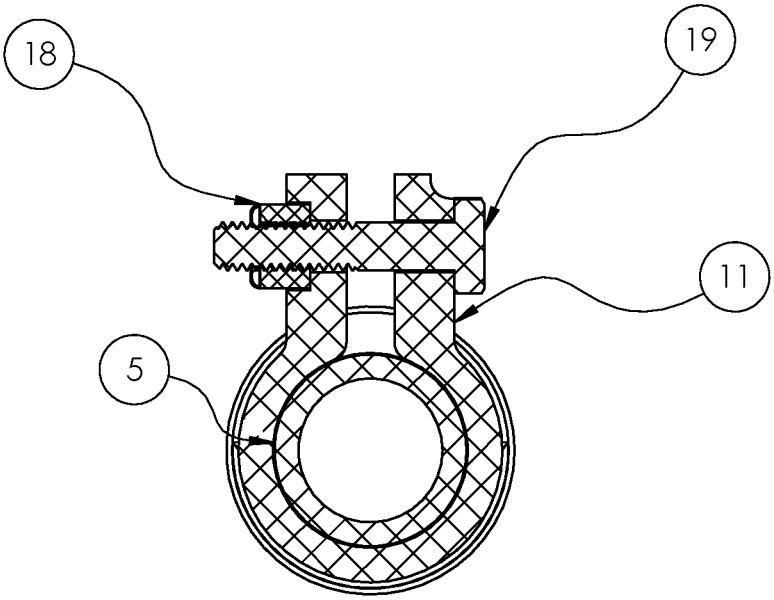
FIG. 8 is a cross section view taken along section C of FIG. 3 to display in detail the plastic clamp, fiberglass tubing, and hardware that allows the telescopic fiberglass intermediate and end tubes to be adjusted in length.

Once the intermediate tube 5 and end tube 6 are positioned so the eyelet bolt 24 sits two inches past the dumpster's front top rim, the tube clamps 11, 12 can be tightened with the ¼" tube clamp hex bolt 19 and nut 18 (See FIG. 8) so that the telescoping intermediate tube 5 and end tube 6 cannot be moved from the device's 29 required length to properly lift and close the dumpster's lid 37. It is this extending pivot arm 3 that ostensibly moves the lid from the open to closed position and vice versa. In FIGS. 1 and 3 the device 29 is positioned below and along the inside right side of the dumpster lid 37 of the trash dumpster 30 and parallel to the right-side top rim 31. The gas spring mounting arm 9 is positioned below the main mounting bracket 2, wide of the right-side rim 31, and on the inside of the right-side wall 32.

Figure 7:
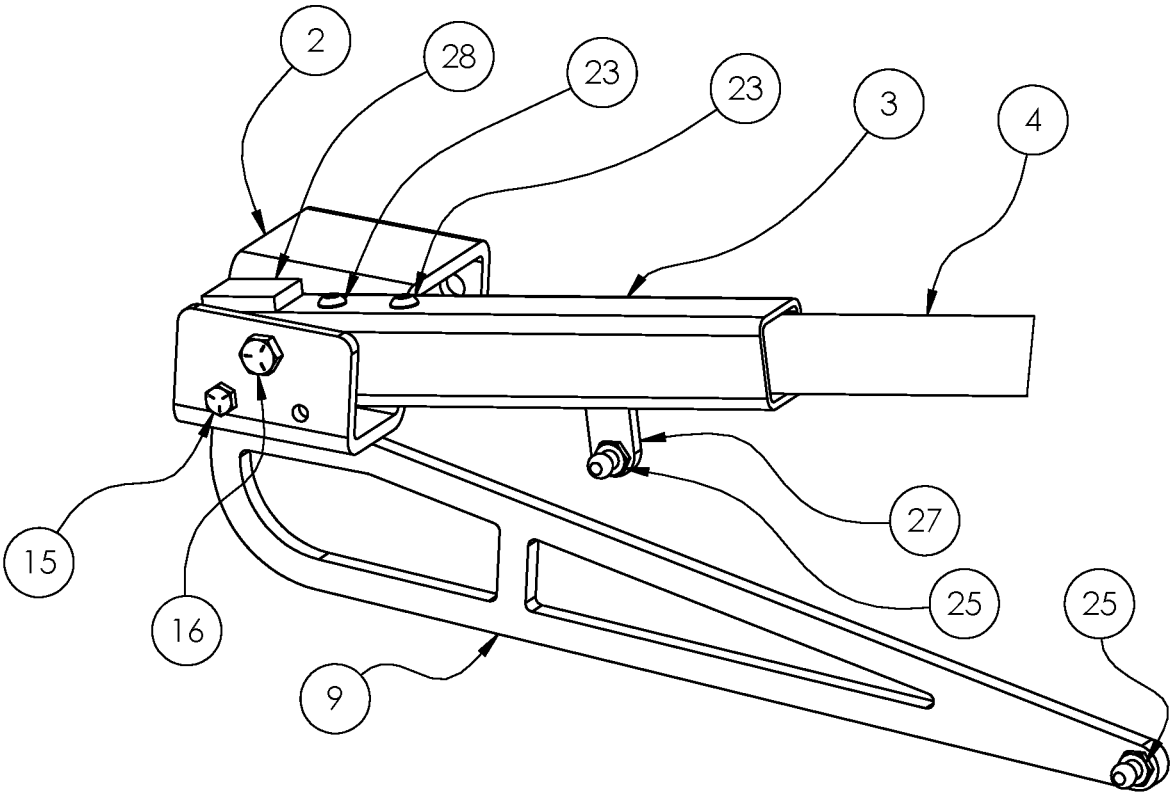
FIG. 7 is a close up side angle view of the main metal components as shown in FIG. 3 that displays in detail the main mounting bracket, pivot arm, pivot arm stop, gas spring mounting brackets, hardware, gas spring ball studs, and how they are attached to the fiberglass adapter tube.

In turning to FIGS. 3 and 7, the main mounting bracket 2 is secured and attached to the dumpster by two ½" main mounting bracket hex bolts 21. The pivot arm 3 is attached to the main mounting bracket 2 with a ⅜" pivot arm hex bolt 16. Also installed on the main mounting bracket is a ¼" stop/guard hex bolt 15 that serves two functions:

1) the stop/guard hex bolt 16 is specifically designed and located so that when the pivot arm 3 reaches the required angled height in the up position, the pivot arm stop 28 hits the ¼" stop/guard hex bolt 15 and does not allow the gas spring 1 to extend to its full extended length so as the preserve the life and integrity of the gas spring shock 1.
2) The stop/guard bolt 15 is also used to mount the pivot guard 8 to cover the back side of the main mounting bracket 2. The pivot guard 8 is designed so that the user of the device 29 cannot put their fingers in or near where the pivot arm 3 and pivot arm stop 28 is located on the main mounting bracket 2, thereby protecting the user from getting their fingers injured when the pivot arm 3 and pivot arm stop moves up or down on the main mounting bracket 2.

Figure 6:
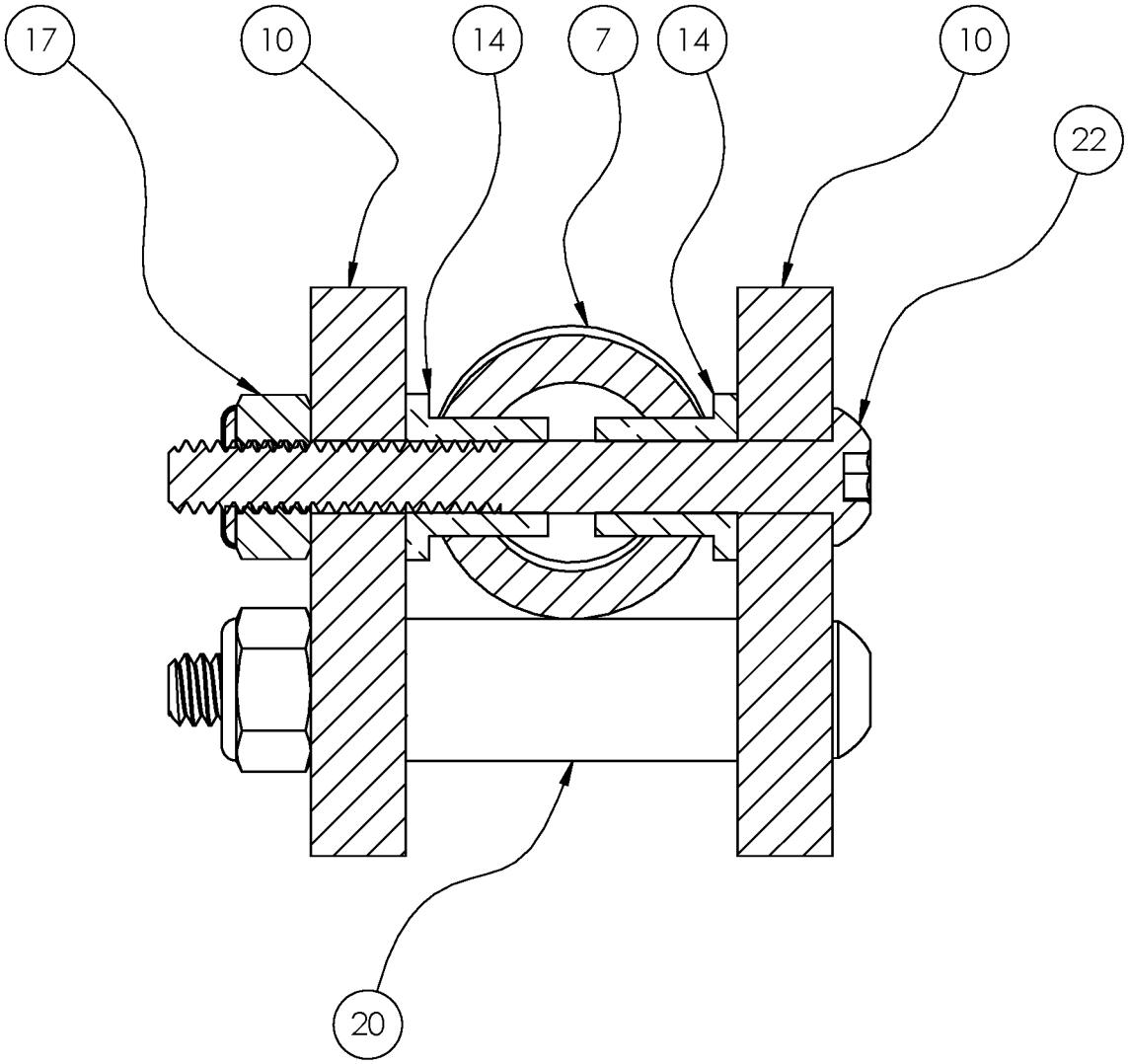
FIG. 6 is a cross section view taken along section A of FIG. 3 to display in detail the cross arm pivot plates and hardware used to hold the cross swing arm attached to the lifting arm, which is used in helping with lifting the flimsy plastic dumpster lid into a more open position.

Located 4" from the end tube 6 is a cross swing arm 7 along with cross arm mounting hardware that are displayed in FIGS. 1, 2, and 3 in its parallel to the front top rim position. The cross arm 7 extends in a perpendicular direction from the end tube 6 and is parallel to and abutting against the inside of the dumpster lid 37 of the trash dumpster 30. Turning to FIGS. 3 and 6, there is illustrated two duplicate sized pivot plates 10 that are attached to the end tube 6. Both pivot plates 10 have four identical holes. A ¾" drilled therethrough in the exact same locations in order to accommodate the mounting of the two pivot plates to the end tube 6. The holes accommodate the attachment of two ⅞" long aluminum tube spacers 20 (7/32" drilled holes) and the cross swing arm 7 (7/32" drilled hole) as well as the insertion of the three button head bolts 22, and the three associated nyloc nuts 17 that are attached to the three button head bolts 22, the cross arm 7, and the two cross swing arm flange bearings 14.

The cross swing arm 7 has a 5/16" hole drilled inline ¼" from one end to accommodate the inline mounting of the two cross arm flanged bearings 14 on each side of the drilled cross swing arm 7 and to allow the mounting of the cross swing arm 7 in line with one of specifically located symmetrically drilled 7/32" holes located on the cross arm pivot plates 10, thus allowing one of the button head screws 22 to pass through, in order, one of the pivot plates 10, the cross swing arm's flanged bearings 14, and the opposite side pivot plate 10. A nyloc nut 17 is screwed onto the threaded end of the button head screw 22 to secure the cross swing arm 7 to the pivot plates 10 that are mounted to the end tube 6.

The two aluminum tube spacers 20 are positioned inline with the other two 7/32" drilled holes and are located between the pivot plates 10. The two aluminum spacers are secured therebetween by passing the two remaining button head screws 22, in order, through one of the pivot plates 10, the aluminum tube spacers 20, and the opposite pivot plate. The remaining two nyloc nuts 17 are screwed onto the threaded end of the button head screws 22. The location of the two aluminum tube spacers and their associated 7/32" drilled holes are designed to stabilize the pivot plates 10, stop the cross swing arm 7 from swinging up past 90 degrees from the front top rim 34 of the dumpster 30 and to rest/stop in a parallel position to the front top rim 34 of the dumpster 30.

The locations of the cross swing arm 7, pivot plates 10, and associated mounting hardware provide stability for the dumpster lid 37, which is often times made of flimsy plastic. Therefore, when the entire device 29 lifts the dumpster lid 37 up into the open position (as shown in FIG. 1 or 2) it holds the dumpster lid 37 in a more open position so that it does not impede the user from throwing out trash, trash bags or small trash containers into the dumpster's 30 empty space 38.

Additionally, when the dumpster 30 is being emptied into the dumpster's 30 trash hauling truck, the dumpster 30 is lifted and turned upside down to allow the trash in the dumpster 30 to be emptied into the dumpster truck's trash hauling container. Therefore, while the dumpster is being used to receive and hold trash by users, the cross swing arm 7 is designed to rest in a parallel position to the front top rim 34 when the apparatus 29 is in a closed position (See FIG. 5) or open position (FIG. 1) and the dumpster is positioned on the ground with the dumpster's bottom 33 facing the ground. Then as the dumpster's trash hauling truck picks up the dumpster 30 to empty the trash in to the dumpster truck's hauling container, the dumpster 30 is positioned so that the dumpster bottom 33 is facing the sky. At this point the cross swing arm 7 will swing to a 90 degree position to allow trash, that is located in dumpster 30, to freely pass by the cross swing arm 7 when a dumpster hauling truck is emptying the dumpster 30.

The invention illustratively disclosed herein suitably may be practiced in the absence of any element which is not specifically disclosed herein.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An apparatus to aid in the lifting a lid on a dumpster from a closed position, maintaining said lid in the open position, and reclosing said lid comprising:

a main mounting bracket for attachment to a side top rim of a dumpster, said main mounting bracket attaching one end to said side top rim of said dumpster and on the opposite end providing a space for the placement and securement therein of a pivot arm positioned inside of said dumpster and attached to said main mounting bracket;

a lower mounting arm attached to the bottom of said main mounting bracket, said lower mounting arm being substantially parallel to said side top rim of said dumpster and angled downward therefrom;

a gas spring attached to the distal end of said lower mounting arm on one end and attached to said pivot arm on the opposite end and filled with gas compression force to lift and close said lid at specific angles;

an adapter tube secured inside of said pivot arm;

an intermediate tube connected to said adapter tube and secured thereto with a first tube clamp;

an end tube connected to said intermediate tube and secured thereto with a second tube clamp;

an eyelet bolt attached to the distal end of said end tube wherein pressure is applicable to said eyelet bolt by lifting or pulling down on said eyelet bolt at the end of said end tube to either move said pivot arm upward to open said lid or downward to close said lid wherein said gas spring provides the force to open or close said lid when said gas spring reaches specific angles;

a cross swing arm positioned substantially parallel to said end tube and extending into the interior of said dumpster and resting against the lid of said dumpster when said dumpster is resting on the ground and that swings outward away from said dumpster lid when said dumpster is turned upside down to remove refuse contained therein.

2. The apparatus as defined in claim 1 wherein a strap is placed through said eyelet bolt.

3. The apparatus as defined in claim 1 further comprising a pair of cross arm pivot plates are placed around said cross swing arm and affixed to said end tube to allow said cross swing arm to pivot therebetween.

4. The apparatus defined in claim 1 further comprising a pivot guard attached to the portion of said main mounting bracket that houses said pivot arm; a pivot stop on the back of said pivot arm and a hex bolt on said main mounting bracket which holds said pivot arm on said main mounting bracket and provides a stop for said pivot stop.

5. A method of lifting a lid on a dumpster from its closed position, maintaining said lid in the open position, and reclosing said lid comprising the steps of:

attaching an apparatus to the perimeter of the open top of a dumpster said apparatus further comprising:

a main mounting bracket for attachment to a side top rim of a dumpster, said main mounting bracket attaching one end to said side top rim of said dumpster and on the opposite end providing a space for the placement and securement therein of a pivot arm positioned inside of said dumpster and attached to said main mounting bracket;

a lower mounting arm attached to the bottom of said main mounting bracket, said lower mounting arm being substantially parallel to said side top rim of said dumpster and angled downward therefrom;

a gas spring attached to the distal end of said lower mounting arm on one end and attached to said pivot arm on the opposite end and filled with gas compression force to lift and close said at lid at specific angles;

an adapter tube secured inside of said pivot arm;

an intermediate tube connected to said adapter tube and secured thereto with a first tube clamp;

an end tube connected to said intermediate tube and secured thereto with a second tube clamp;

an eyelet bolt attached to the distal end of said end tube wherein pressure is applicable to said eyelet bolt by lifting or pulling down on said eyelet bolt at the end of said end tube to either move said pivot arm upward to open said lid or downward to close said lid wherein said gas spring provides the force to open or close said lid when said gas spring reaches specific angles;

a cross swing arm positioned substantially parallel to said end tube and extending into the interior of said dumpster and resting against the lid of said dumpster when said dumpster is resting on the ground and that swings outward away from said dumpster lid when said dumpster is turned upside down to remove refuse contained therein;

applying pressure to said eyelet bolt at the end of said end tube to either move said pivot arm upward to open said lid or downward to close said lid wherein said gas spring provides the force to open or close said lid.

6. The method as defined in claim 5 wherein a strap is placed through said eyelet bolt.

7. The method as defined in claim 5 further comprising a pair of cross arm pivot plates are placed around said cross swing arm and affixed to said end tube to allow said cross swing arm to pivot therebetween.

8. The method defined in claim 5 further comprising a pivot guard attached to the portion of said main mounting bracket that houses said pivot arm; a pivot stop on the back of said pivot arm and a hex bolt on said main mounting bracket which holds said pivot arm on said main mounting bracket and provides a stop for said pivot stop.

* * * * *